US006108986A

United States Patent [19]

Hiramoto et al.

[11] Patent Number: 6,108,986

[45] Date of Patent: Aug. 29, 2000

[54] EARTHQUAKE-RESISTANT LOAD-BEARING SYSTEM

[75] Inventors: Takashi Hiramoto; Hidehiko Kimishima; Yutaka Kawai; Hirofumi Mori, all of Tokyo, Japan

[73] Assignee: Kawasaki Steel Corporation, Japan

[21] Appl. No.: 09/064,659

[22] Filed: Apr. 23, 1998

[51] Int. Cl.[7] ..... E04H 9/02

[52] U.S. Cl. ..... 52/167.6; 52/167.1; 52/167.4; 52/167.5

[58] Field of Search ..... 52/167.1, 167.4, 52/167.5, 167.6, 167.7, 167.8

[56] References Cited

U.S. PATENT DOCUMENTS

| | | | |
|---|---|---|---|
| 4,330,103 | 5/1982 | Thuries et al. | 52/167.1 X |
| 4,496,130 | 1/1985 | Toyama | 52/167.6 X |
| 4,527,365 | 7/1985 | Yoshizawa et al. | 52/167.8 |
| 5,078,529 | 1/1992 | Moulton | 52/167.1 X |
| 5,131,195 | 7/1992 | Bellavista | 52/167.1 |
| 5,456,047 | 10/1995 | Dorka | 52/167.1 X |
| 5,466,068 | 11/1995 | Andra et al. | 52/167.1 X |
| 5,490,356 | 2/1996 | Kemeny | 52/167.1 X |
| 5,568,705 | 10/1996 | Bellavista | 52/167.1 |
| 5,597,239 | 1/1997 | Scaramuzza et al. | 52/167.4 X |
| 5,597,240 | 1/1997 | Fyfe | 52/167.1 X |

FOREIGN PATENT DOCUMENTS

| | | |
|---|---|---|
| 4-65193 | 10/1992 | Japan . |
| 7-56326 | 12/1995 | Japan . |

*Primary Examiner*—Beth A. Stephan
*Assistant Examiner*—Brian E. Glessner
*Attorney, Agent, or Firm*—Austin R. Miller

[57] ABSTRACT

An earthquake resistant structure for mounting on a base having a limited available surface has an upper bearing and a lower bearing compactly arranged, one with a convex surface and the other with a concave surface, in contact with each other to transmit load between a bridge and a supporting pier, for example, the bearings being slidable relative to each other; a pin is provided for fixing the upper and lower bearings and an extraction preventing member prevents the bearings from separating from each other; a seal member is disposed between the upper bearing and the lower bearing; and a dust prevention and anti-corrosion cover are provided to assure long-time use.

16 Claims, 7 Drawing Sheets

EARTHQUAKE-RESISTANT LOAD-BEARING SYSTEM

BACKGROUND OF THE INVENTION

1. Field of the Invention

The present invention relates to an earthquake-resistant load-bearing system, and relates particularly to a system utilizing an isolated bearing for supporting a heavy structure such as a bridge, or a building or the like. It more particularly relates to an isolated bearing mounted on a relatively narrow surface such as a bridge-supporting pier or the like, and supporting an upper structure such as a bridge main body, for example. More particularly, the invention relates to an isolated load-bearing system comprising an upper bearing and a lower bearing supporting an upper construction load upon a lower base wherein the upper and lower bearings positioned in slidable contact with each other.

2. Description of the Related Art

In constructing a pier for a bridge, for example, a structure is made such that a bearing is placed between the upper surface of the pier and the lower structure of the upper part of the bridge, thereby supporting the load of the upper structure upon the pier. If the bearing is a conventional one, the whole pier and the whole bridge are in danger of receiving damage if it encounters a major natural disaster such as an earthquake, for example. In recent years, many suggestions have been made for protecting structures from earthquakes.

Among them, one suggestion embodies using laminated rubber in all or a part of the intermediate bearing construction. However, this encounters a problem of rocking, and is not suitable.

In Examined Published Japanese Patent No. 4-65193, there is disclosed a technique in which the position of an upper structure, which has temporarily moved due to an earthquake, is restored to its original position by gravity. However, in accordance with this gravity-oriented technique, the supporting surface requires a significantly widened area since the apparatus used for preventing the structure from inverting, by vertical oscillation due to the earthquake, is independently provided out of the isolated bearing main body. This is not suitable for use in a structure which is mounted on a supporting surface of limited area, such as a pier only, which sustains the upper structure, and which has a relatively narrow area.

On the contrary, as an example of an isolated bearing being made compact, mention is made of a buffer-type spherical bearing as disclosed in Examined Published Japanese Utility Model No. 7-56326. This is a spherical bearing having a spherical seat between an upper bearing and a lower bearing, and is provided with buffer members opposing each other in a sliding direction. It has the purpose of preventing motion due to an earthquake. An unevenness is provided in a center portion of a spherical contact portion between the upper bearing and the lower bearing, and the structure is made such that a small amount of movement is absorbed by the spherical seat. The isolated bearing is compact, but is hardly useful for absorbing the vertical oscillation of an earthquake. Further, since the structure is designed around a spring that absorbs vibration energy by horizontally moving with respect to the horizontal oscillation, the system is not suitable for restricting responsive displacement with respect to strong vibration. Still further, the periphery of the contact portion between the upper bearing and the lower bearing is directly exposed to wind and rain, and dust can easily enter between.

For example, in a heavy bridge, a collision occurs when a great amount of responsive displacement of the upper structure occurs, it is necessary to restrict the responsive displacement at the time of the earthquake to a limited degree, and to damp out the resulting oscillation as soon as possible. Further, since an isolated bearing mounted on a pier is directly exposed to wind and rain, and since dust can easily enter into the bearing portion, it is necessary to overcome this problem as well. However, there has been no concrete suggestion so far.

SUMMARY OF THE INVENTION

An object of the present invention is to provide an earthquake-resistant system comprising an isolated bearing that can be mounted on a supporting surface having a small area, for example, a pier of a bridge.

In other words, the object is to provide an isolated bearing that can be made compact, can effectively operate on a narrow area on a pier, can have good operability (performance), can restrict excess responsive displacement of a pier upper structure, and can absorb and damp the earthquake energy of a major earthquake. Further, the invention relates to a particular mechanism of this type that protects its own bearing system from damage due to wind, rain and dust.

In order to achieve the objectives mentioned above, an isolated bearing system is provided comprising an upper bearing and a lower bearing opposing each other and having contact surfaces in contact with each other, in position to transmit the load of an upper structure to a lower structure, and vice versa, in which one such bearing has a convex surface and the other has a concave surface, all with ability to undergo sliding movement with respect to each other. The opposing surfaces of the upper bearing and the lower bearing are shaped to provide a space for inserting a pin for fixing the upper structure relative to the lower bearing. Preferably, the upper construction fixing pin and the corresponding insertion hole are disposed in such a manner as to extend through at least a part of the contact areas of the opposing bearing surfaces. Further, an extraction preventing mechanism is provided between the upper bearing and the lower bearing. It is disposed at peripheral portions of the upper bearing and the lower bearing. This is important to achieve success with an isolated compact bearing.

Further, in the isolated bearing system, the extraction preventing mechanism comprises a flexible wire member having both ends fixed relative to the upper and lower bearings. The wire member is fixed to a bearing through an elastic body in at least one end. In a preferred form, the extraction preventing structure is arranged such that the extraction preventing mechanism comprises a flexible wire, a bolt directly connected to the wire and a nut for fixing the bolt to the upper bearing and the lower bearing. At least one end of the bolt is fixed to either of the upper or lower bearing through a spring.

Further, preferably, in accordance with the invention, the bearing structure includes a seal member that is disposed between the upper bearing and the lower bearing, thereby protecting the bearings from wind, rain and dust. Still further preferably, in accordance with the invention, the bearing structure is built so that the upper bearing and the lower bearing are surrounded, and that an energy absorbing member is disposed between the upper structure and the lower structure (such as a pier), thereby restricting excessively responsive displacement in the upper structure, and quickly absorbing earthquake energy. Concretely speaking, a mild steel or dead soft steel having a low yield point and great elongation is employed as the material.

DETAILED DESCRIPTION OF THE PREFERRED EMBODIMENT

Figure 1:
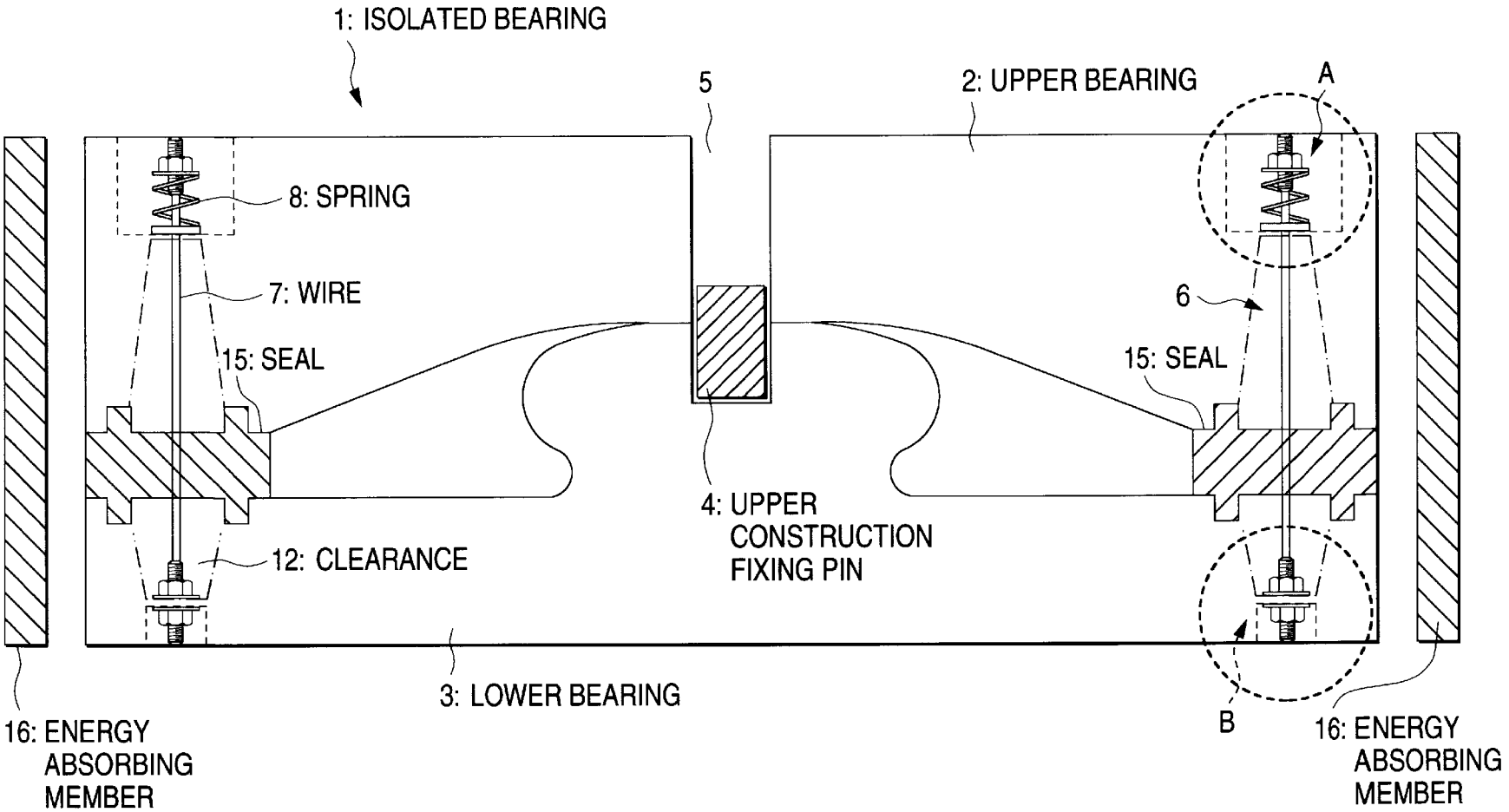
FIG. 1 is a vertical sectional view which shows one form of isolated bearing system in accordance with this invention.
Figure 2:
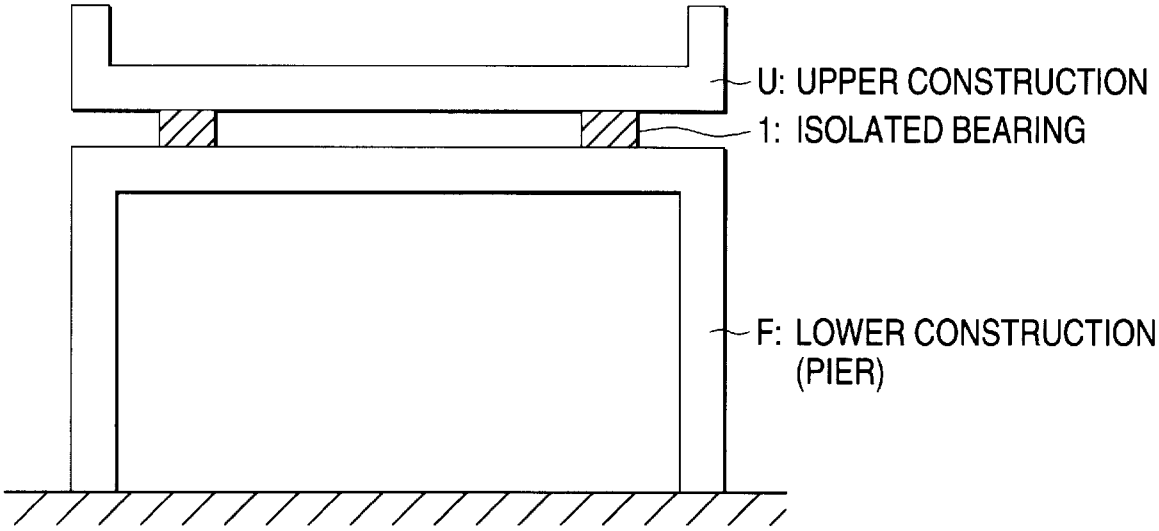
FIG. 2 is a vertical sectional view which shows one form of mounting for an isolated bearing in accordance with the invention.

The following description is directed to the specific forms of the invention selected for illustration in the drawings. It is not intended to define or to limit the scope of the invention, which is defined in the appended claims. Referring now to FIG. 1 of the drawings, the isolated bearing 1 in accordance with the invention has an upper bearing 2 and a lower bearing 3, one upon the other, as shown in FIG. 1. They are structured such that one has a concave surface and the other of them has a convex surface, the surfaces being in contact with each other, with capacity to mutually slide at a time of an earthquake. The isolated bearing 1 is mounted between a lower structure such as a pier F (FIG. 2) and an upper construction U as also shown in FIG. 2. Bearing 1 damps the transmission of earthquake energy from the lower to the upper structure.

Preferably, the upper bearing 2 has a concave surface and the lower bearing 3 has a convex surface having a radius of curvature substantially equal to or slightly less than that of the upper bearing 2. Accordingly, they are normally kept in surface contact with each other due to the load of the upper structure U, thereby transmitting the whole load to and through the lower bearing. The curvature of the contact surface between the upper bearing 2 and the lower bearing 3 is determined by taking into consideration the slidability of both, and the amount and kind of the anticipated reaction force of the upper construction at the contact surface of the bearings.

The upper bearing 2 and the lower bearing 3 are integrally formed of a steel material having sufficient strength equal to or better than a normal bearing. However, its contact surface is readily slidable in response to earthquake energy without the sliding being limited in direction. In the case of a bridge, for example, since only the conditions existing at the time of a great earthquake are important, the structure needs to have sufficient anti-corrosive treatment, even if its frictional resistance is allowed to become slightly increased. In the FIGS. 1–2 embodiment, the upper bearing 2 is shaped to have a concave surface and the lower bearing 3 is shaped to have a convex surface. However, an inverted construction can be employed as well.

Preferably, since it is difficult for rain water and rust to accumulate in the concave portion when the upper bearing has the concave surface, the concave sliding surface will be protected from the elements and is convenient from the viewpoint of maintenance.

Further, taking ease of mutual sliding into consideration, it is preferable to make the convex surface portion a little wider than the desired contact area determined by the amount of the upper construction load. As shown in FIG. 1, the extent of the concave surface of the upper bearing is greater than the peripheral area of the convex portion of the lower bearing. Accordingly, the convex surface portion of the lower bearing has room to slide easily with respect to the concave surface portion of the upper bearing. In summary, the structure is made such that the upper and lower bearings can be mutually slid in response to major earthquake force, but that the horizontal engagement configuration between the upper bearing and the lower bearing is not easily altered.

A pin 4 (FIG. 1) is provided for fixing the position of the upper construction. An insertion hole 5 for the pin 4 is disposed in such a manner as to extend the contact portion between the upper bearing 2 and the lower bearing 3. The pin 4 fixes the upper construction U (FIG. 2) to the lower construction(pier) F (FIG. 2) so that the upper construction U does not move due to a normal force applied thereto, such as a wind force or a force due to vehicle running on a bridge, or a force applied by a slight earthquake. It is structured to be broken by a large earthquake force received from the upper construction U, thereby breaking the fixation of the bearings and the connection between the upper construction U and the lower construction F, allowing free movement of the upper construction U with respect to the lower construction F. Accordingly, the thickness of the pin 4 may be determined by considering the earthquake acceleration and the mass of the upper construction U, in order to achieve the function mentioned.

Figure 5:
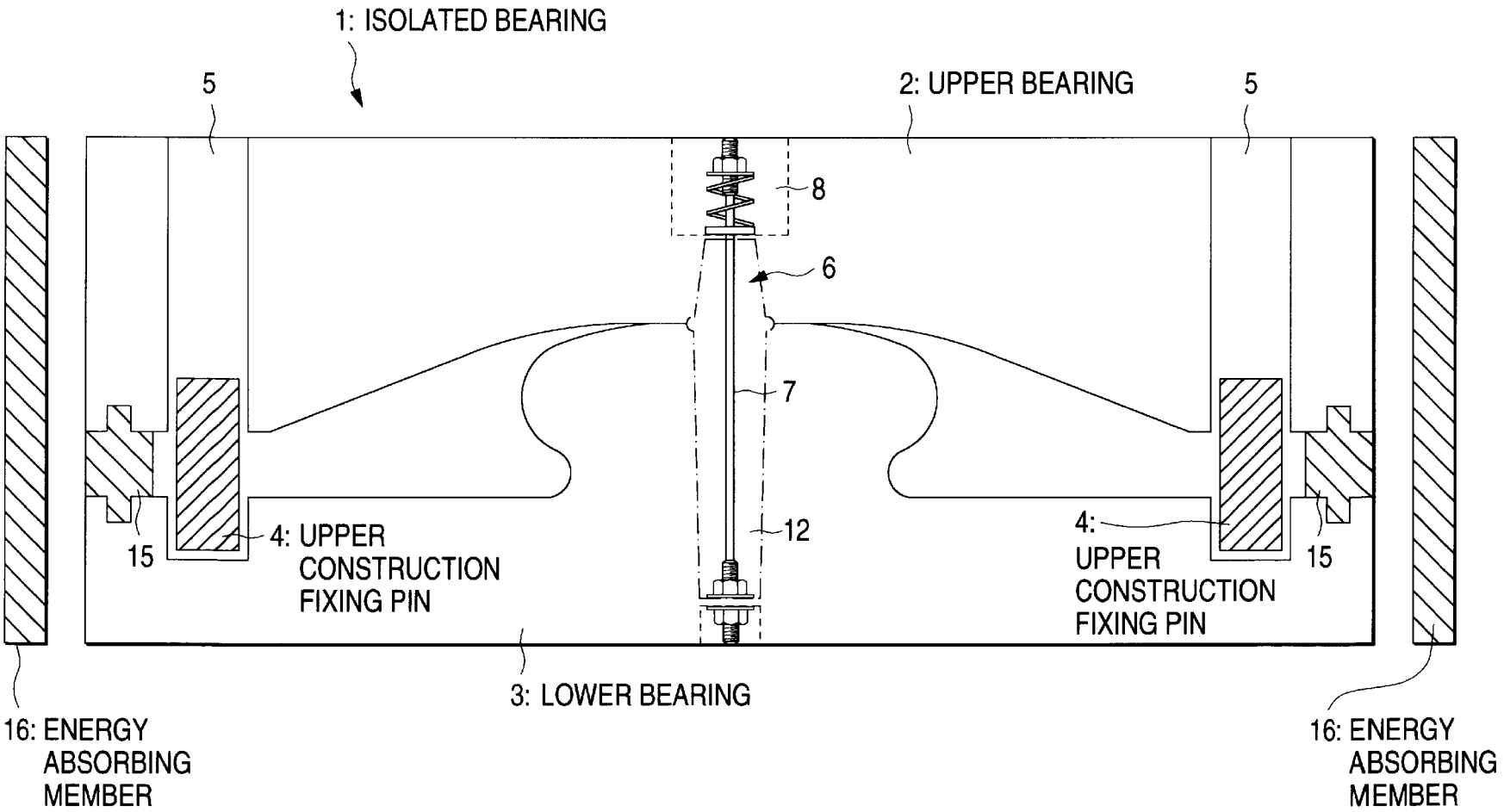
FIG. 5 is a vertical sectional view which shows another form of isolated bearing system in accordance with this invention.

The insertion hole 5 for the pin 4 is provided for later replacing a broken pin caused by an earthquake. This is done by inserting a new pin into the hole 5. It further is provided for inspecting and replacing the pin 4 when an earthquake disaster has not occurred for a long time. It is sufficient as far as the insertion hole extends through the upper bearing and to a depth of the lower bearing for inserting the pin, as shown in FIG. 1. Accordingly, its diameter can be about the same as that of the pin 4. Preferably, the pin 4 is disposed to extend through the contact portion between the upper bearing and the lower bearing, as shown in FIG. 1, or at least one pin 4 may be provided at a peripheral portion of the upper and lower bearings. as shown in FIG. 5.

A separation preventing mechanism 6 for the upper bearing and the lower bearing is provided at the peripheral portion of the bearings 2 and 3 as shown in FIG. 1. It extends through the bearings 2 and 3, and serves to prevent the upper bearing 2 from jumping or being pulled up (together with the upper construction U) in a vertical direction due to the earthquake and from later dropping down with great force. This provision is designed to prevent the lower bearing 3 and the lower structure F from breaking apart.

Figure 3:
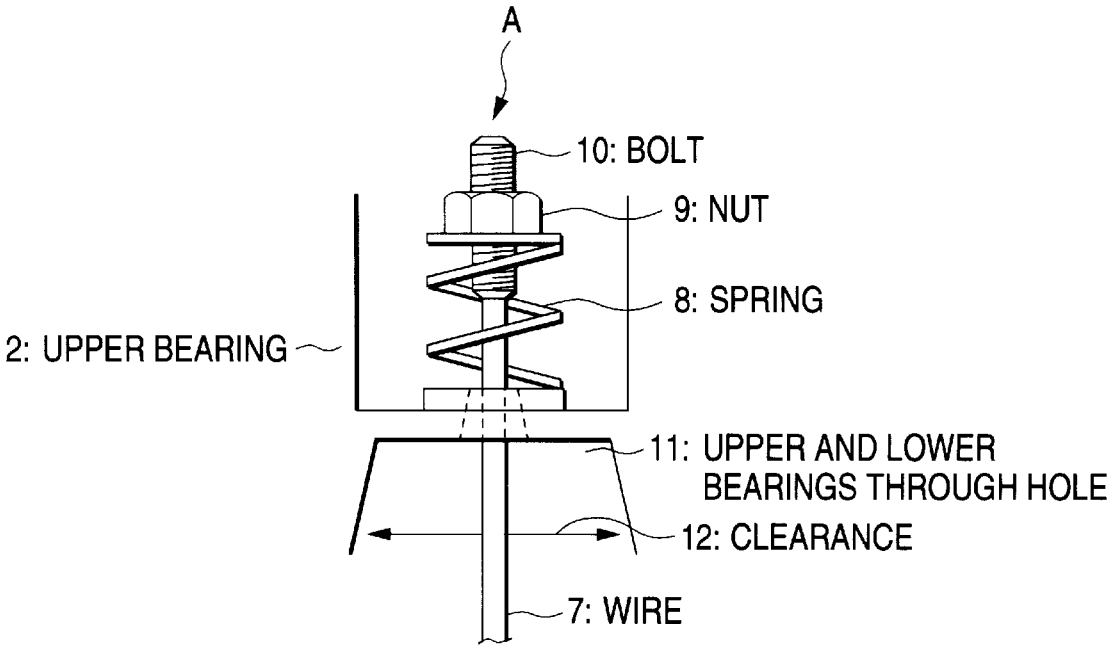
FIG. 3 is a schematically enlarged view which shows a form of mounting of an extraction preventing mechanism, as related to an upper bearing in accordance with this invention.

A detailed structure of an upper end portion of the separation preventing mechanism 6 is shown in FIG. 3. It connects the upper bearing 2 and the lower bearing 3 with a flexible wire 7, having a spring 8 at a supporting point. To adjust the resistant force, a nut 9 and a bolt 10 are directly connected to the wire. The wire extends through a hole 11 extending through the upper and lower bearings. However a clearance 12 is provided between the hole 11 and the wire 7 to form a floating hole. Accordingly, not only is separation prevented but in addition mutual sliding between the upper bearing and the lower bearing is allowed to be easily performed due to a multiplier action between the spring and the clearance. In this case, a plurality of extraction preventing mechanisms 6 may conveniently, if desired, be provided at various places along the peripheries of the upper bearing 2 and the lower bearing 3. They are received within the isolated bearing, making the isolated bearing very compact.

Figure 4:
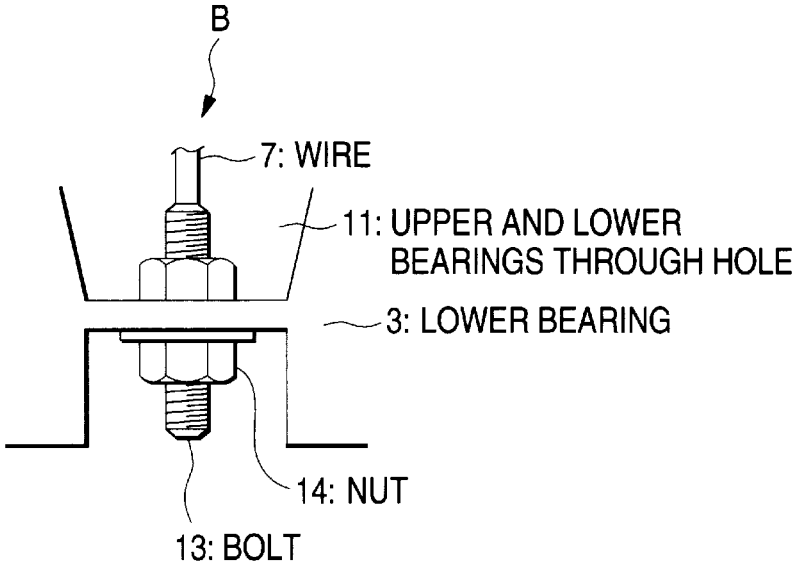
FIG. 4 is a schematically enlarged view which shows a form of mounting of an extraction preventing mechanism to a lower bearing.

FIG. 4 shows the lower portion of the wire structure, labeled "B". The mounting of the wire 7 to the lower bearing is shown. As shown in FIG. 4, a bolt 13 is directly connected to an end of the wire 7, and is fixed to an outer peripheral portion in the lower bearing through a nut 14.

In the isolated bearing in accordance with this invention, a seal is preferably provided between the upper bearing and the lower bearing in order to protect the bearing contact areas from corrosion due to wind and rain, and to prevent dust from entering the area. Accordingly, slidability is maintained for a long time between the upper bearing 2 and the lower bearing 3.

Preferably, as shown in FIG. 1, a seal member 15 such as laminated rubber is disposed around the periphery of the upper bearing and the lower bearing. In this case, when the seal comprises laminated rubber, relative motion and vibration between the upper bearing 2 and the lower bearing 3 at the time of an earthquake are damped by the laminated rubber. The seal member 15 is made of a material that preferably absorbs energy. However, the seal means is not limited to laminated rubber; a soft synthetic resin such as a polyurethane or a rubber O-ring may be employed instead.

In accordance with the invention, it is preferable that the upper bearing and the lower bearing are surrounded, and that the energy absorbing member 16 is disposed between the upper structure U and the lower structure F. Accordingly, when the upper bearing 2 and the lower bearing 3 are undergoing great relative motion due to an earthquake, the movement range is largely restricted within the inner diameter of the energy absorbing member and the deforming range thereof. Kinetic energy by acceleration due to the earthquake can be absorbed and damped by deformation of the energy absorbing member. Therefore, after the earthquake wave has stopped, the oscillation of the upper construction 2 can be relatively quickly reduced and stopped.

It is sufficient that the energy absorbing member 16 is formed as a generally cylindrical shape surrounding the upper bearing and the lower bearing. Its dimension is established such that its inner diameter is determined by taking the outer diameter of the upper bearing and the lower bearing and the relative expected movement of the upper bearing and the lower bearing. For example, it is preferable to add the relative allowable movement of the outer diameters of the upper bearing and the lower bearing to the outer diameter of the upper bearing or the lower bearing. Accordingly, the interval between the inner diameter of the energy absorbing member 16 and the outer diameter of the upper bearing and the lower bearing is designed to be smaller than the expected relative movement, or amount of shift, between the upper bearing and the lower bearing. The disposition is effective when it surrounds the upper bearing 2 and the lower bearing 3. It is not necessary to fix it to the upper construction U or the lower construction F. The energy absorbing cylinder 16 can protect the contact surface between the upper bearing and the lower bearing while cooperating with the seal member mentioned above, or replacing the function of the seal member as far as it is disposed between the upper construction U and the lower construction F in a pressing state. Or the same effect can be achieved when the energy absorbing member 16 is disposed in close contact with the upper construction U and the lower construction F.

Any energy absorbing member can be employed if it can absorb the kinetic energy of the construction due to the earthquake. However, a dead soft steel is particularly preferable, because dead soft steel has a low yield point, has a great elongation up to breakage, and absorbs energy by deformation when impact external energy is applied.

Figure 6:
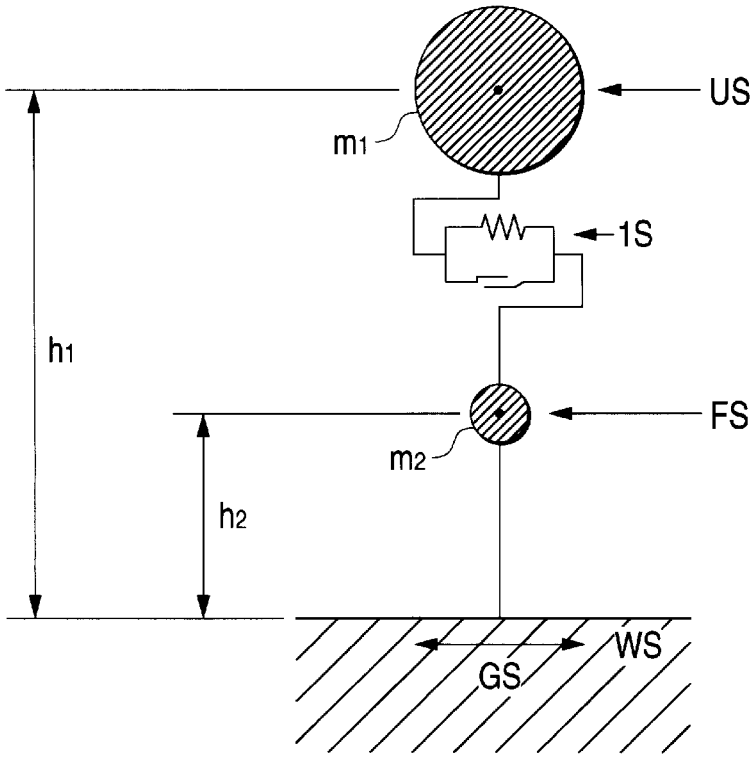
FIG. 6 is a sketch of a device for analyzing a dynamic response used as a simulation for confirming effectiveness in accordance with the invention.

As an example, considering the bearing 1 shown in FIG. 1 as a non-elastic spring, as shown in FIG. 6, an upper construction (a bridge) US having a mass (m1) of 1200 tons and a center of gravity height (h1) of 20 m is supported by the bearing 1S, and a non-elastic spring type dynamic responsive analyzer mounted on a pier FS having a mass (m2) of 75 tons and a center of gravity height (h2) of 17.5 m is made. In this case, the pier is formed in a cylindrical shape made of steel. The cross-sectional area (A) of the pier is 3200 $cm^2$, and the cross-sectional secondary moment (I) of the pier is 30,000,000 $cm^4$. In this model, by inputting an earthquake wave WS having the same dimension as the actual earthquake wave in the famous HYOGOKEN NANBU EARTHQUAKE (north and south component recorded in KOBE KAIYO WEATHER STATION) in a direction parallel to a ground surface GS, a simulation experiment in accordance with the invention was performed. As a result, when rigidly connecting the pier and the upper construction without providing the isolation bearing of this invention, the responsive displacement at the upper end of the pier was 34.1 cm. However, using the isolation bearing in accordance with the invention, the displacement was significantly reduced to 10.6 cm.

Figure 7:
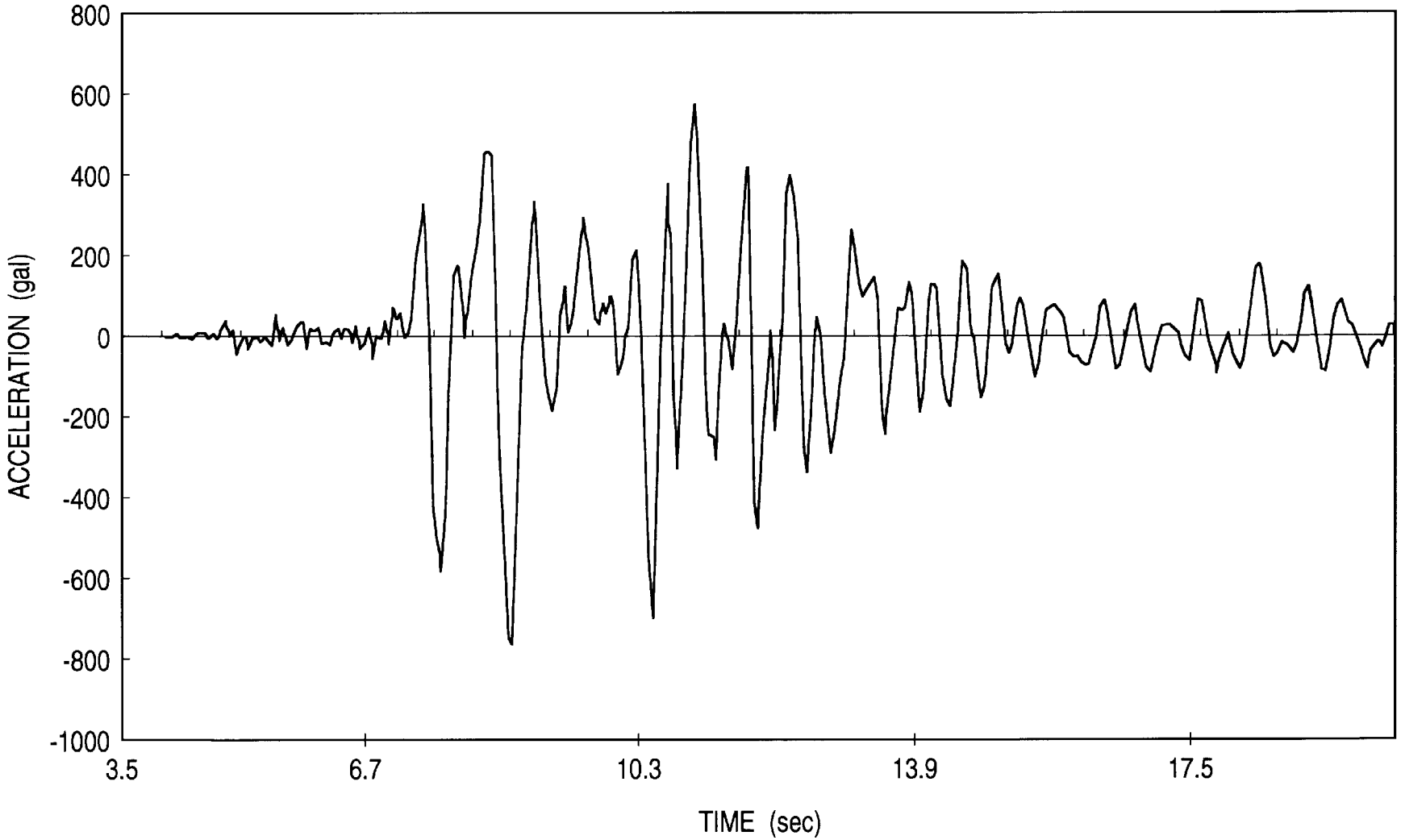
FIG. 7 is a schematic view which shows a wave form of an input earthquake in a simulation for confirming effectiveness in accordance with the invention.
Figure 8:
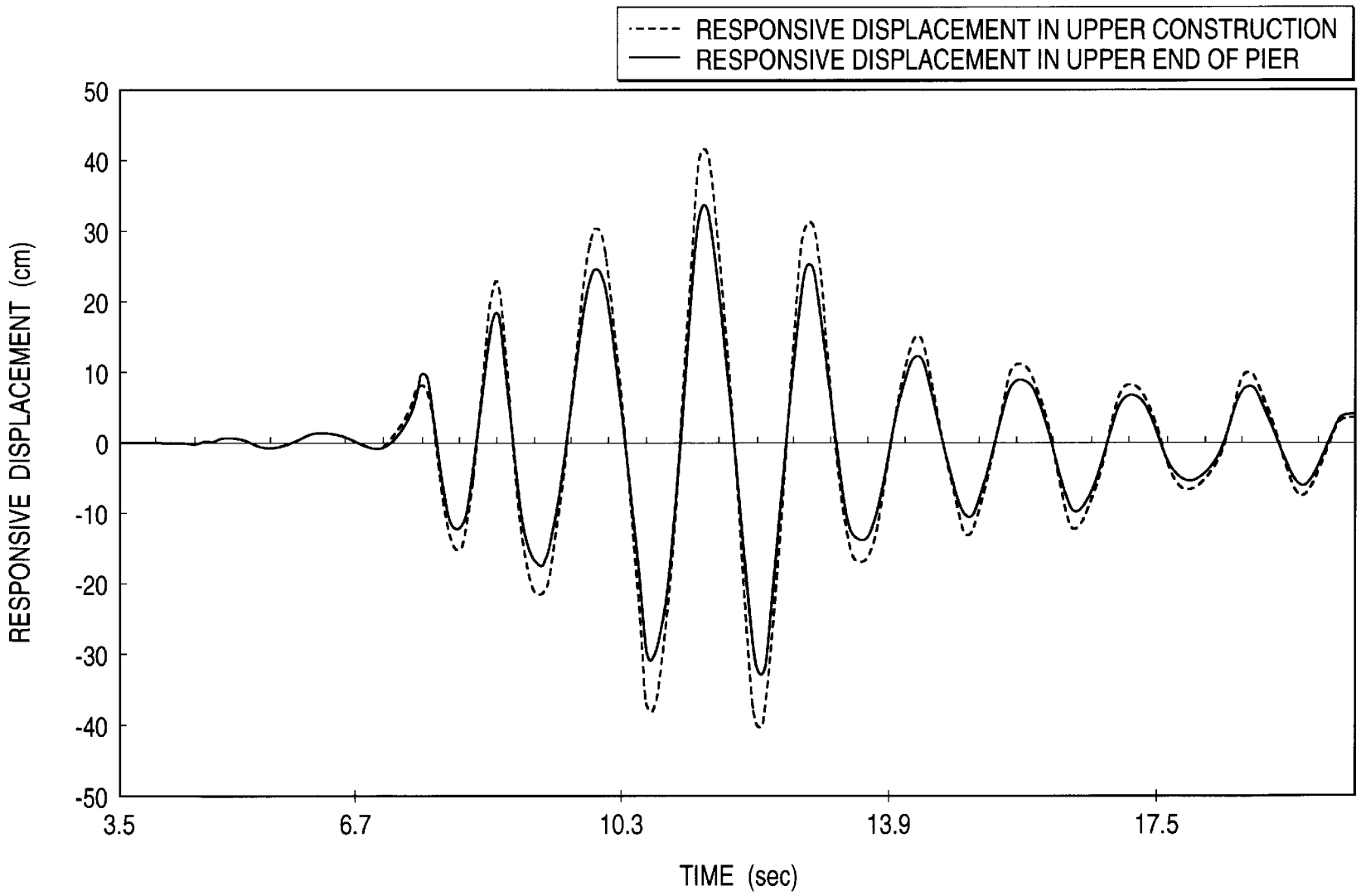
FIG. 8 is a schematic view which shows responsive displacement of an upper structure and a pier head portion when rigidly connected without using any isolated bearing in accordance with the invention.
Figure 9:
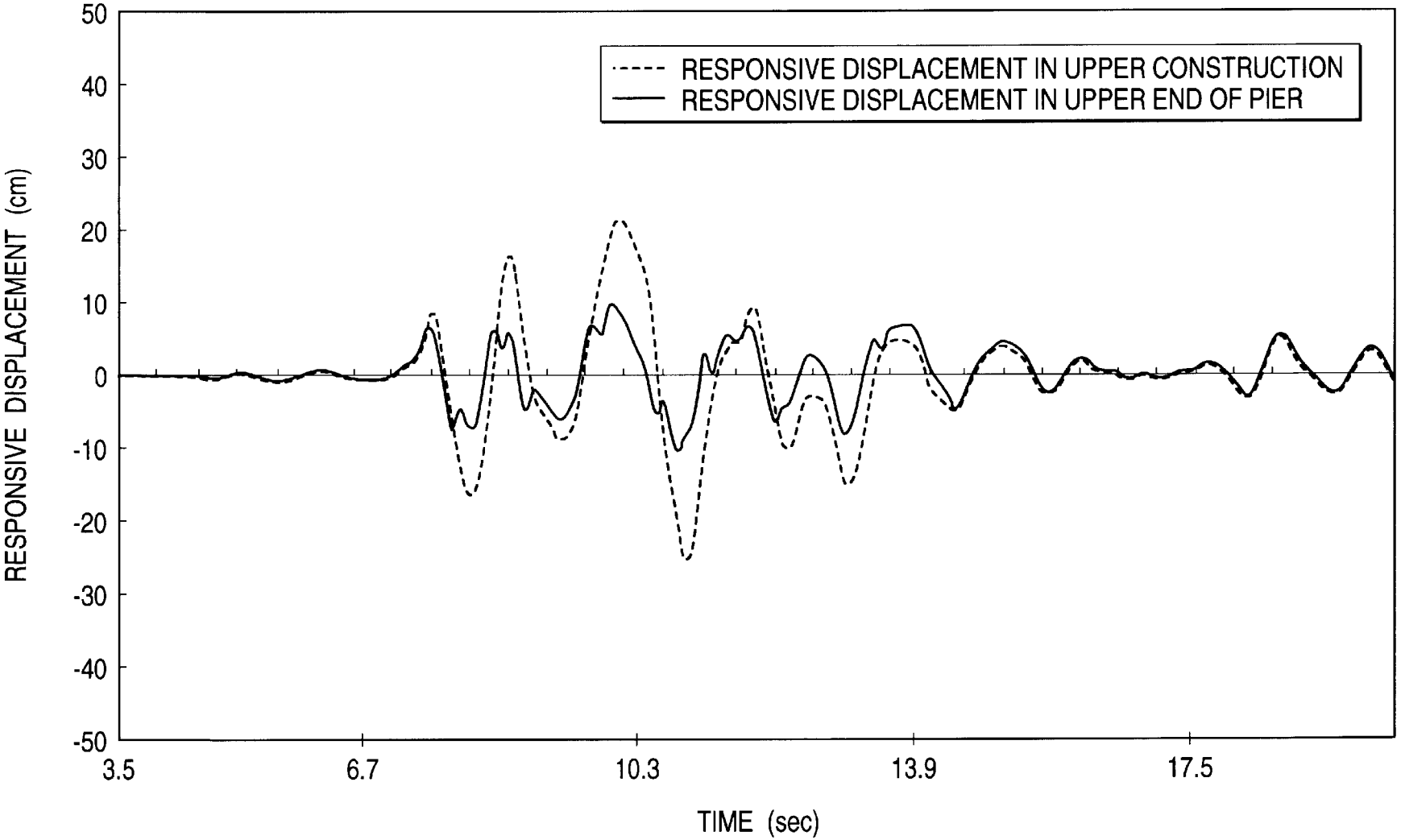
FIG. 9 is a schematic view which shows responsive displacement of an upper structure and a pier head portion when using an isolated bearing in accordance with the invention.

FIG. 7 shows the input vibration of the earthquake wave WS, FIG. 8 shows the responsive displacement in the case when the isolation system was not provided, and FIG. 9 shows the responsive displacement using the isolation bearing in accordance with the invention.

This invention provides an integrated and compact isolated bearing that allows the lower construction such as the pier and the base to be compact. It can easily achieve prevention of damage even in major disasters. Further, since the invention embodies an anti-corrosion and dust prevention capability as shown and described, maintenance can be easily performed and long-time use can be realized.

What is claimed is:

1. An isolated bearing structure for minimizing earthquake damage comprising an upper bearing and a lower bearing positioned for supporting said upper bearing, said bearings having curved bearing surfaces capable of supporting an upper construction upon a lower construction, wherein one of said curved bearing surfaces is convex and the other curved bearing surface is concave, said curved bearing surfaces being slidable with respect to each other, and wherein said upper bearing and said lower bearing are provided with an opening extending through said upper and lower bearings and their curved bearing surfaces and wherein a fixing pin is positioned in said opening for fixing said upper bearing and said upper construction relative to said lower bearing and said lower construction, said fixing pin being constructed of a shape and size to be broken by a major earthquake force and to free said upper bearing and said upper construction for movement independently of said lower bearing.

2. An isolated bearing defined in claim 1, further comprising a yieldable extraction preventing mechanism connected to said upper bearing and said lower bearing at a peripheral portion of said upper bearing and said lower bearing, with capacity to resist separation of said upper and lower bearings under the influence of a major earthquake while allowing free relative movement of said upper and lower bearings.

3. An isolated bearing defined in claim 1, wherein said pin and said opening are disposed to extend through said curved bearing surfaces of said bearings, and wherein an extraction preventing mechanism for said bearings is with capacity to resiliently resist separation of said upper and lower bearings under the influence of a major earthquake at a peripheral location on said upper bearing and said lower bearing, and connected to both said upper bearing and said lower bearings.

4. An isolated bearing defined in claim 2, wherein said extraction preventing mechanism is a flexible member having its ends fixed to said upper bearing and said lower bearing.

5. An isolated bearing defined in claim 4, wherein said flexible member is fixed to one of said bearings through an elastic body at at least one of its ends.

6. An isolated bearing defined in claim 4, wherein the flexible member is a wire.

7. An isolated bearing defined in claim 5, wherein said elastic body is a spring.

8. An isolated bearing defined in claim 2, wherein said extraction preventing mechanism is constituted by a flexible wire, bolts directly connected to said wire and a nut for fixing said bolts to said upper bearing and said lower bearing, and wherein at least one end of each said bolt is fixed to each of said bearings through a spring.

9. An isolated bearing defined in claim 1, wherein a seal member is disposed between said upper bearing and said lower bearing.

10. An isolated bearing defined in claim 9, wherein said seal member comprises a material having an energy absorbing capability.

11. An isolated bearing structure for minimizing earthquake damage comprising; 1) an upper bearing; 2) a lower bearing positioned for supporting said upper bearing, said bearings having contact surfaces capable of supporting an upper construction upon a lower construction, wherein one of said bearing contact surfaces is convex and the other is concave, said surfaces being slidable with respect to each other, and wherein said upper bearing and said lower bearing are provided with an opening extending through said upper and lower bearings and their contact surfaces and wherein a fixing pin is positioned in said opening for fixing said upper bearing and said upper construction relative to said lower bearing and said lower construction, said fixing pin being constructed of a shape and size to be broken by a major earthquake force and to free said upper bearing and said upper construction for movement independently ot said lower bearing; and 3) a bridge and a pier having an upper surface, and an energy absorbing member surrounding said upper bearing and said lower bearing and disposed between said bridge and said upper surface of said pier, said energy absorbing member having an inside dimension that is spaced to allow relative movement of said upper and lower bearings through a distance corresponding to the expected amount of relative shift of said bearings in a major earthquake.

12. An isolated bearing defined in claim 11, wherein said energy absorbing member is composed of dead soft steel.

13. The bearing defined in claim 1 wherein said upper bearing is shaped and sealed to provide protection of said bearings from wind, rain and dust.

14. The bearing defined in claim 13, wherein a resilient pheripherial seal is provided between the edges of said upper and lower bearings.

15. The bearing defined in claim 1 wherein said concave surface of said upper bearing has a greater extent than does the convex surface of said lower bearing.

16. The bearing defined in claim 1 wherein said upper and lower bearings include a gap between parts of their facing bearing surfaces.

* * * * *